US005413846A

United States Patent [19]

Besana

[11] Patent Number: 5,413,846

[45] Date of Patent: May 9, 1995

[54] ELASTICIZED ARTIFICIAL LEATHER AND PROCESS FOR ITS PRODUCTION

[75] Inventor: Raffaele Besana, Frosinone, Italy

[73] Assignee: Man Made S.R.L., Ferentino, Italy

[21] Appl. No.: 197,542

[22] Filed: Feb. 17, 1994

Related U.S. Application Data

[63] Continuation of Ser. No. 863,910, Apr. 6, 1992, abandoned.

[30] Foreign Application Priority Data

Apr. 5, 1991 [IT] Italy ..... RM91A0227

[51] Int. Cl.[6] ..... B05D 5/00; B32B 27/00

[52] U.S. Cl. ..... 428/229; 428/230; 428/231; 428/245; 428/259; 428/260; 428/315.7; 428/377; 428/423.1; 428/423.7; 428/425.1; 428/479.3; 428/904; 427/340; 427/341; 427/342; 427/354

[58] Field of Search ..... 428/229, 230, 231, 246, 428/259, 260, 315.7, 315.9, 377, 423.1, 423.5, 479.3, 904, 245, 423.7, 425.1; 427/340, 341, 342, 354

[56] References Cited

U.S. PATENT DOCUMENTS

| | | | |
|---|---|---|---|
| Re. 32,594 | 2/1987 | Theissen | 156/229 |
| 2,031,375 | 2/1936 | Lilley | 139/421 |
| 3,199,548 | 8/1965 | Conant | 428/231 |
| 3,438,842 | 4/1969 | Petterson | 161/77 |
| 3,524,792 | 8/1970 | Dawes | 428/231 |
| 3,544,357 | 12/1976 | Noda et al. | 117/63 |
| 4,190,694 | 2/1980 | Mück et al. | 428/423.3 |
| 4,217,381 | 8/1980 | Asano | 427/340 |
| 4,563,384 | 1/1986 | Wiehe et al. | 428/231 |
| 4,640,858 | 2/1987 | Barnett | 428/90 |
| 4,803,118 | 2/1989 | Sogi | 428/246 |

FOREIGN PATENT DOCUMENTS

| | | |
|---|---|---|
| 2108839 | 10/1970 | France . |
| 0620390 | 3/1949 | United Kingdom . |
| 1262823 | 2/1972 | United Kingdom . |

*Primary Examiner*—Stevan A. Resan
*Attorney, Agent, or Firm*—Browdy and Neimark

[57] ABSTRACT

The following describes elasticized artificial leather characterized in that it is formed by a woven support material comprising warp threads and weft threads, said material being coated on at least one of its two sides by at least one layer of synthetic polymer, said woven material having its weft made from elasticized yarn produced using elastomeric fibers. A further object of the present invention is a process for production of the elasticized artificial leather.

7 Claims, 4 Drawing Sheets

ELASTICIZED ARTIFICIAL LEATHER AND PROCESS FOR ITS PRODUCTION

This application is a continuation of application Ser. No. 07/863,910, filed Apr. 6, 1992, now abandoned.

BACKGROUND OF THE INVENTION

1. Field of the Invention

The present invention relates to a new elasticized artificial leather and a process for its production.

2. Description of the Prior Art

The problem of producing artificial leathers capable of substituting for natural leather has been felt in the state of the art for a long time. A number of products have been produced from synthetic materials with the object of obtaining products of lower cost than natural leather, but which at the same time maintain unchanged the look and feel of natural leather itself. For example, it is possible to mention a poromer produced from a web of polyesters coated with polyurethane and known by the trade name of Corfam, produced by Du Pont, which is employed as an artificial leather for various uses. In particular all the synthetic leathers produced up to now have shown insufficient modellability, for example in the production of articles of clothing such as shoes or other products. Furthermore, the state of the art shows no artificial leathers having structural elasticity, that is to say the ability to stretch under traction, with immediate return to their original size.

There was therefore a need in the state of the art for leathers that, although produced from synthetic materials, showed a modellability of finished products similar to that of natural leather, with at the same time the same look and "feel" of natural leather and furthermore a high level of elasticity.

It has now surprisingly been found that an artificial leather made from a woven material, in which at least the threads of the weft are made of an elastomeric fiber, makes it possible to obtain a product which, as well as looking exceptionally like natural leather from an aesthetic point of view, is more modellable than the artificial leathers known from the prior art, and has a much greater elasticity than that of natural leathers.

SUMMARY OF THE INVENTION

Object of the present invention is therefore an elasticized artificial leather characterized in that it is made of a woven support material comprising warp threads and weft threads, coated on at least one of its two sides with a layer of synthetic polymer, the weft threads in said woven material being formed by elasticized yarn produced using elastomeric fibers.

A further object of the present invention is a process for the production of elasticized artificial leather, including the operations of:

a) preparing a woven support material comprising warp threads and weft threads, said weft threads being formed by an elasticized yarn produced using elastomeric fibers;

b) applying at least once on at least one side of said woven material a solution of a synthetic polymer in a solvent therefor, until a pre-determined amount of said polymer remains fixed to said woven material;

c) soaking said woven material to which said polymer has been applied in a bath containing said solvent for the polymer and a non-solvent of said polymer for the time required for said synthetic polymer to coagulate, said solvent and said non solvent of said synthetic polymer being totally or largely miscible one with the other;

d) washing with water; and e) drying.

BRIEF DESCRIPTION OF THE DRAWINGS

Four figures are enclosed with the present description.

In the figures the same reference numbers are used to indicate corresponding parts.

DETAILED DESCRIPTION OF THE INVENTION

The elasticized artificial leather according to the present invention is formed by a woven support material, which is then coated on at least one side by at least one layer of synthetic polymer. The woven material has the threads forming its warp made of cellulose fibers, such as cotton or the like, alone or mixed with polyester fibers (used to increase strength). The polyester fibers are present in a quantity ranging from 0 to 70%, with reference to the total amount of fibers employed for production of the warp.

The weft of the support material is made of elasticized yarn. A particularly preferred embodiment uses threads based on segmented polyurethane, such as Lycra (segmented polyurethane elastofiber produced by Du Pont).

The elasticized thread forming the weft of the woven support material is coated with two layers of fiber material. The first layer is made up of polyamide fibers to regulate the elasticity of the finished product; said polyamide fibers are then covered, during twisting, with a cellulose fiber thread or with a thread of mixed cellulose-polyester fiber. In the thread of mixed cellulose-polyester, the polyester thread content can be substantially of up to 50%.

The woven support material for the elasticized leather according to the present invention is covered on at least one of its two sides with at least one layer of synthetic polymer. Said synthetic polymer is chosen from the class of polyurethanes, dissolved in their solvents.

For preference, monocomponent polyurethanes with a sequential structure are used, which alternate rigid segments and soft segments, with a strictly linear structure, obtained by polymerization from:

A) a long chain diol,

B) an aromatic isocyanate,

C) a short chain diol.

The coating of synthetic polymer can take place on one or on both sides of the woven material; it is possible to coat a double layer of the same or different synthetic polymer on both sides of the support material. Coagulation of the synthetic polymer applied onto the woven support material, which will be better described here below, gives the finished elasticized leather a porosity very similar to that of natural leather.

Figure 4:
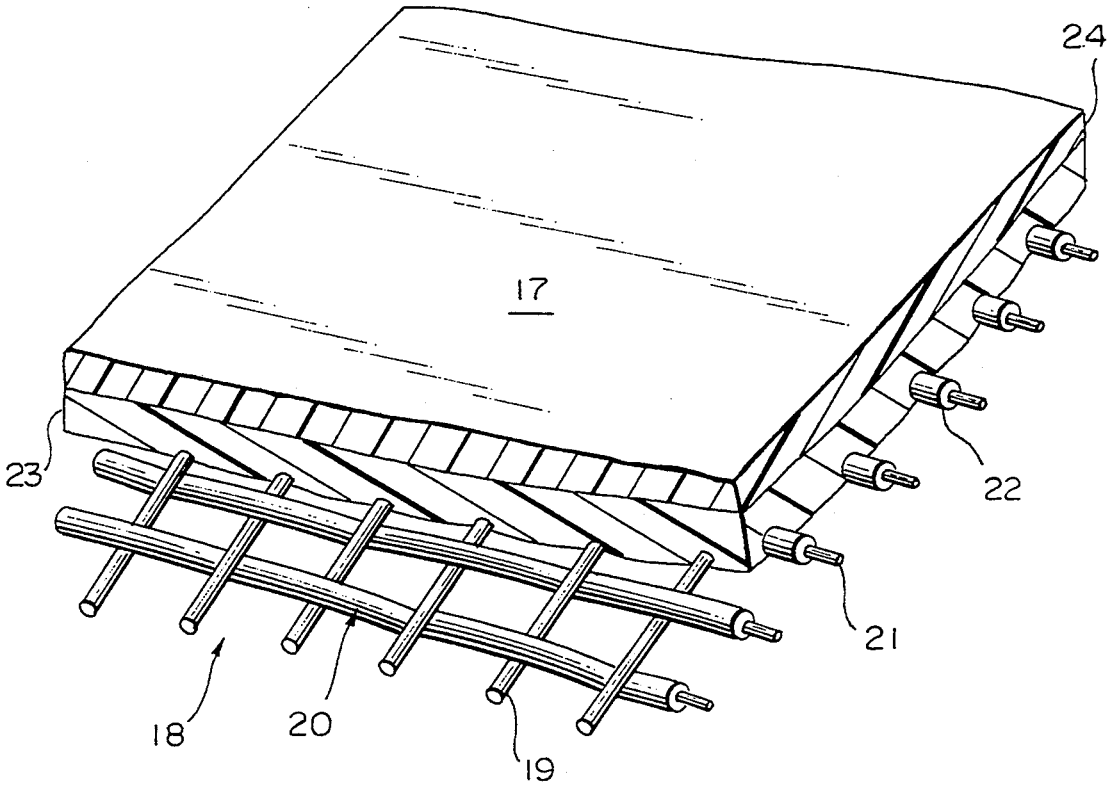
FIG. 4 shows a portion of the woven support material coated with two layers of polyurethane coatings on the same side of the support material.

FIG. 4 shows the elasticized leather 17 according to the invention. Onto the same side of the woven support material 18 two layers of synthetic polymer have been coated. The warp threads 19 are made of cellulose fibers or mixed cellulose/polyester fibers. The weft threads 20 are made of an elasticized yarn 21 (made of segmented polyurethane) coated with an inner layer of polyamide fibers and then covered with an outer layer of cellulose threads. Both these layers are not shown separately but are indicated together with 22. Onto one side of the woven support material two layers of polyurethane have been applied, indicated with and 23 and 24, respectively.

The pores obtained have a diameter of between 10 and 80 μm, preferably between 30 and 50 μm. The elasticized leather according to the present invention has a number of advantages with respect to the products belonging to the prior art, said advantages being essentially provided by its elastic structure due to the elastomeric fiber forming the weft of the woven support material. The product obtained is a material having the appearance of natural leather, which is also capable of stretching when put under traction, returning immediately to its original size. This characteristic renders the articles made therefrom more modellable and more resistant. In fact the characteristic of elasticity makes it possible to prevent the stress loads of the manufactured article itself from discharging into limited areas, causing wear and consequently breakage more rapidly than is seen in articles made of natural leather. The elasticized leather according to the present invention can be finished by means of subsequent operations similar to those used for natural finished leathers. The great similarity of this material to natural leather is in fact due to its internal structure, which gives a particularly faithful reproduction of the flesh side of natural leather. The elasticized leather object of the present invention can undergo a large number of different treatments to give it a wide variety of appearances, to name but a few suede, calf, patent leather, reptile skin etc., according to the requirements of the final user. With reference to the enclosed figures a process for production of elasticized leather will now be described as a non-limiting example. The woven support material, in which it is assumed that the warp is made of cotton or other cellulose fibers, optionally mixed with polyester fibers, and the weft is made of elasticized yarn, after having been coated with substantially non-extensible materials, such as polyamides, for example, and covered during the twisting stage with a thread of cellulose fiber such as cotton or a mixed cellulose/polyester fiber, has to undergo further treatments before the synthetic polymer is applied and then coagulated.

The treatments which the woven support material has to undergo are the following:

a) desizing (removal of the size, that is to say the various dressing substances, such as starch and the like, which are applied to the warp threads to facilitate the weaving processes);

b) dyeing, according to the requirements of the finished product;

c) raising (raising of both sides) (extraction of the hairs): this operation, which is indispensable for successive operations, is made possible by the fact that the surfaces of the material are made up of cotton or polyester-cotton, with which the elastomeric fiber has been covered;

d) cutting (trimming all the hairs extracted in the preceding operation to the same length);

e) heat fixing at a temperature of between 170° and 200° C. This treatment serves to stabilize the elasticity of the woven material within the desired limits, which are set according to the final use to which the elasticized leather is to be put.

It is possible to obtain a pre-determined elongation of the elasticized leather of between 20 and 50% by length of the starting product in the direction in which the elastic deformation takes place, that is to say in the direction in which the weft of elastomeric fibers runs. The methods to be followed in order to obtain the amount of elongation desired after heat fixing are described in Du Pont Technical Information Bulletin N° L- 517.

Once the woven support material has been prepared according to the above described methods, the synthetic polymer is applied and then coagulated.

Figure 1:
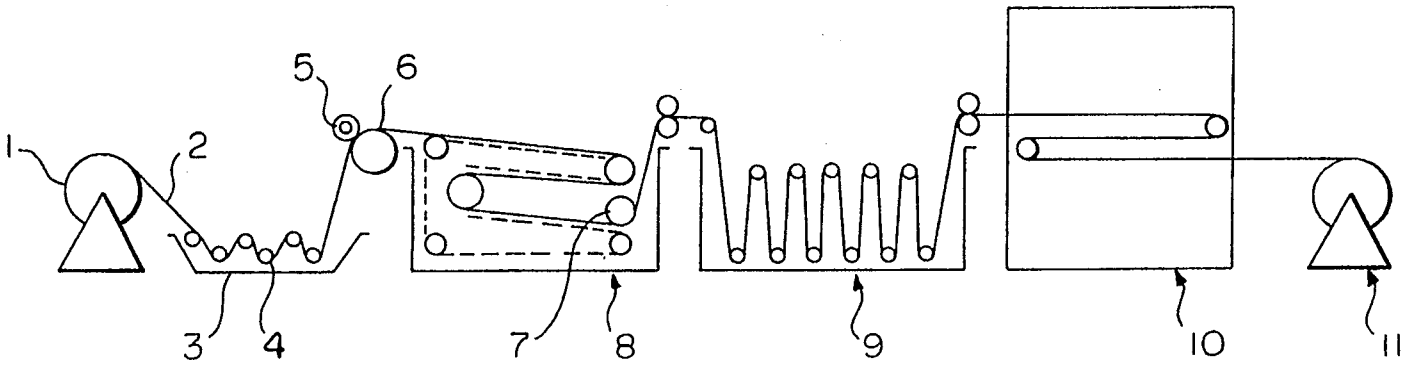
FIG. 1 is a schematic representation of a plant for performing the process according to the present invention, in which the application of said synthetic polymer onto the woven support material takes place by means of impregnation.

With reference to FIG. 1 there is shown schematically a plant performing the process according to the present invention. From a feeding roller 1, which contains woven support material that has undergone the heat fixing process described above, the material 2 is unwound and immersed in a bath 3 containing the synthetic polymer to be applied, dissolved in its solvent. Among the polymers to be applied it is possible to mention, for example, polyurethanes, preferably those having a molecular weight of between 50.000 and 150.000. Preferably, the content of dry synthetic polymer is of between 7 and 12% by weight of the solution, and it is pigmented with the desired colour. For use, the solution must have a viscosity of between 200 and 300 cps. In the bath 3 rollers 4 define the route taken by the material 2. The material 2 then crosses rollers 5 and 6 which control the thickness of the layer of synthetic polymer applied onto the material itself, causing any excess solution taken up by the material 2 to fall back into the bath 3.

Figure 2:
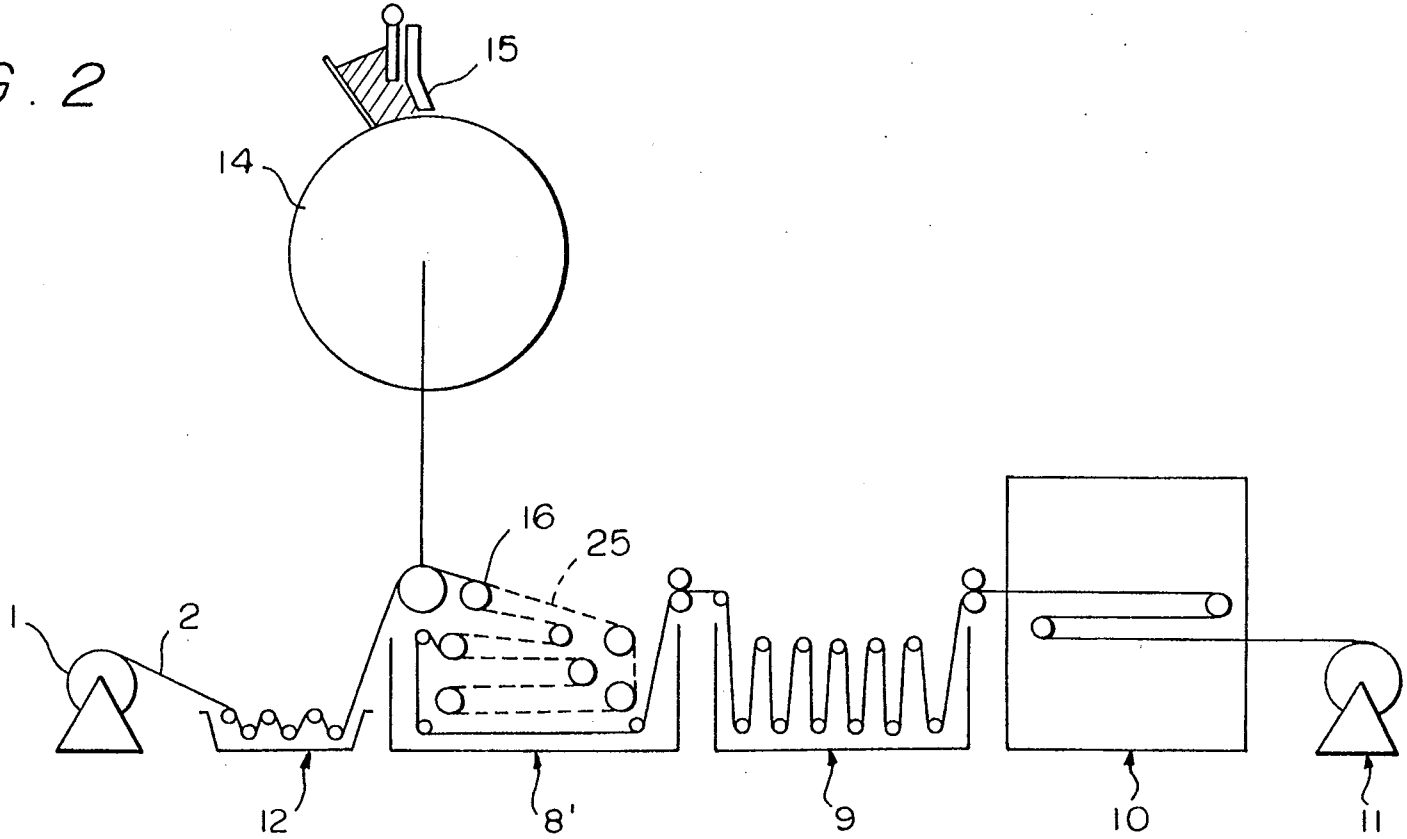
FIG. 2 is a schematic representation of a plant in which application of said polymer onto said material takes place by means of direct controlled spreading using a doctor blade, with an enlarged detail showing the wiping blade.
Figure 3:
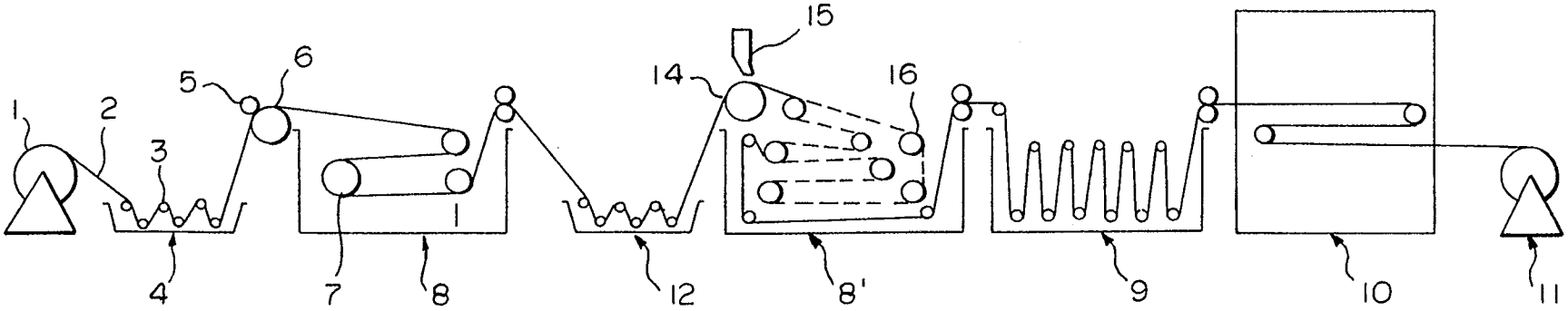
FIG. 3 is a schematic representation of a plant for performing the process according to the present invention, in which in a first stage application of said synthetic polymer onto the woven support material takes place by means of impregnation, and in a second stage it takes place by means of direct controlled spreading using a wiping blade.

In FIG. 2 is shown an alternative version of the process according to the present invention, in which the material 2 enters the bath 12 and passes over the roller 14, application by means of direct spreading being controlled by means of the doctor blade 15 which controls the thickness, cooperating with the roller 14, said detail being shown in an enlarged scale in said figure. The material 2, held up by rollers 16, is then fed into the bath 8. In this case the content of synthetic polymer from the solution will be of 12–20% by weight with respect to the solvent, and the final viscosity will be between 600 and 1000 cps. In FIG. 3 is shown another alternative version of the process according to the present invention, according to which it is possible to apply a first layer of synthetic polymer by means of impregnation in the bath 4 and a second layer by means of spreading controlled by the wiping blade 15. In this case the two layers of coating on the support material can be either the same or different.

In the case of application by means of spreading it is preferred to add an inert filler to the solution of synthetic polymer in its solvent, said filler being for example cellulose powder. Making reference, for simplicity, to FIG. 1, the coagulation stage proper will now be described.

The support material 2, after leaving the calibrating rollers 5 and 6, enters the bath 8 supported by rollers 7. In the bath 8 there is a mixture of a solvent of the coating polymer and a non-solvent of the same polymer, said solvent and said non-solvent being totally or largely miscible one with the other. The composition of the solvent/non-solvent mixture is the following: non-solvent 65–80%, solvent 20–35%.

As it passes through the bath 8, the combined action of the solvent and of the non-solvent on the synthetic polymer causes the coating to harden and form an open-cell microporous structure having a size (diameter) of between 10 and 80 μm, preferably of between 30 and 50 μm. The coagulation process takes place within the bath 8 at room temperature. However, in a preferred embodiment of the process according to the present invention, it is preferred to keep the temperature of the coagulation bath 8 at a constant temperature of between 30° and 35° C., to maintain the high elasticity of the product unchanged. Lower temperatures can, in fact, modify the cell structure of the product, and adversely affect the elasticity.

In the processes known in the prior art, in the coagulation bath the material is held up by rollers. In the case of the present invention, on the contrary, it is preferred to use endless supporting means (shown as 25 in FIG. 2), similar to those used in "rameuses" to dry fabric, so as to avoid excessive tensions caused by the compression effect of the idler cylinders (the idler cylinders touching the material on the side where the coating is thickest and not yet perfectly coagulated, cause excessive compacting of the structure, which can have a negative influence on the elasticity). Once it leaves the bath 8, in which the coagulation took place, the woven support material, onto which the synthetic polymer has been applied and coagulated, is immersed in the bath 9 where it is washed using the non-solvent, so as to remove any residual solvent in the pores which have formed and so as to complete the coagulation process. Among the preferred solvents can be mentioned, for example, dimethylformamide, and among the non-solvents, water. The woven support material coated with completely coagulated synthetic polymer, after leaving the bath 9, enters the oven 10 in which it is dried, held up by a clip arrangement. The temperature of the oven is adjusted so as to obtain optimum drying without damaging the product (up to a maximum temperature of around 140° C.). Finally, the elasticized leather leaving the oven 10 is rolled up on the collection roller 11.

The elasticized leather manufactured according to the process of the present invention can be further treated to give it the appearance and decorations required by the final user. Among these treatments, the following can be mentioned:

a) spreading, transfer coating of the coagulate, using methods known from the state of the art, with a film of polyurethane or other coloured polymer having the required appearance, for example goatskin, calf etc.;

b) treating with abrasive materials to obtain a suede effect;

c) embossing, that is to say pressing with engraved cylinders to give the required "leather" look;

d) printing, for example to give the required shade of colour.

Two examples of production of artificial elasticized leather according to the present invention will now be given.

EXAMPLE 1

Artificial elasticized leather for the manufacture of shoe uppers.

a) Preparation of the support material

A material having the following characteristics was used:

30 warp threads per cm 17 weft threads per cm

Yarn used for warp: mixed (50% cotton-50% polyester) count NE16.

Yarn used for the weft: 420 decitex elastomer Lycra covered with elasticized 6/6 nylon and twisted with two strands of mixed yarn (50% cotton-50% polyester) count NE 30. The operation of twisting with the two strands of cotton/polyester (450 turns per meter with "S" twisting) is performed after having steam fixed the "S" twist into the nylon.

Reinforcement: cloth raw height: 240 cm.

The raw material was desized and bleached using stabilized hydrogen peroxide. After drying in the "rameuse" it was passed twice along a raising line; this raising line is made up of 8 raisers on the right side plus two trimmers and of 4 raisers on the back side plus one trimmer. Following the raising operation, the material was heat fixed in the rameuse at 190° C. for 1 minute, bringing its height to 155 cm.

b) Manufacture of the coagulate

The material prepared for coagulation had the following characteristics: weight 280 g/m$^2$; thickness 0,7 mm; elasticity 40%.

Coating with polymer was performed by means of spreading (with reference to FIG. 2) using a solution of polyurethane having a dry content of 12%, coloured black and to which is added 2% of powdered cellulose (ARBOCELL BE 600/30 produced by J. RETTENMAIER & SOHNE—Germany) so as to obtain a viscosity of 600 centipoise.

For coagulation, a solution of $H_2O$/DMF with 30% DMF was used, and during this operation the material was kept slightly stretched (in a transverse direction) using the clip arrangement. After washing and drying, the coagulate was spread with three layers of polyurethane coloured black using a transfer card with "calf" grain. The product thus obtained had a weight of 500 g/m$^2$, a thickness of 1,1 mm and a residual elasticity of 20%.

EXAMPLE 2

Artificial elasticized leather for the manufacture of clothing a) Preparation of the woven support material A support having the following characteristics was used: 30 warp threads per cm., 24 weft threads per cm.

Yarn used for warp: pure cotton, count NE16.

Yarn used for the weft: 150 decitex elastomer Lycra covered with 6/6 nylon elasticized and twisted with two strands of pure cotton, count NE 36. The operation of twisting is exactly the same as that given in example 1.

Reinforcement: cloth raw height: 240 cm.

The raw material was desized and bleached, dried in the "rameuse" and passed once along the raising line (as described above in example 1). Following this, the material was heat fixed in the rameuse at 185° C. for 1 minute, bringing its height to 150 cm.

b) Manufacture of the coagulate

Characteristics of the material prepared for coagulation:

Weight 190 g/m$^2$; thickness 0,6 mm; elasticity 50%.

Coating with polymer was performed by means of impregnation (with reference to FIG. 1), using a solution of polyurethane having a dry content of 10% and a viscosity of 220 centipoise, coloured brown. For coagulation, a solution of $H_2O$/DMF with 25% DMF was used, and during this operation the material was kept slightly stretched (in a transverse direction) using the clip arrangement. After washing and drying, the coagulate was spread with two layers of polyurethane coloured brown using a transfer card with "soft leather" grain. Following this, the material was print finished with darker brown spotting and a nitrocellulose varnish additioned with wax. The product thus obtained had a weight of 280 g/m$^2$, a thickness of 0,75 mm and a residual elasticity of 35%.

I claim:

1. Elasticized artificial leather consisting essentially of a woven material comprising warp threads and weft threads, said woven material being impregnated with a solution of polyurethane and then immersed in a bath containing a solvent and a non-solvent for said polyurethane whereby said polyurethane coagulates to form a layer of a coagulated polyurethane coating on at least one of two sides of said material, said weft threads in said woven material being formed of segmented polyurethane fibers which have been coated with polyamide fibers which are then covered with a fiber selected from the group consisting of cellulose fibers and mixtures of cellulose and polyester fibers.

2. The elasticized artificial leather according to claim 1 wherein said warp threads are selected from the group consisting of cellulose fibers and mixtures of cellulose and polyester fibers.

3. A process for the production of elasticized artificial leather comprising:

(a) preparing a woven support material comprising weft threads and warp threads, said weft threads being made of elasticized polyurethane which have been coated with polyamide fibers which are then covered with a fiber selected from the group consisting of cellulose fibers and mixtures of cellulose and polyester fibers;

(b) applying at least once on to least one side of said woven material a solution of a synthetic polymer in a solvent for said synthetic polymer, until said woven material is coated on at least one side with a predetermined amount of said synthetic polymer;

(c) immersing said woven material to which said polymer has been applied in a bath containing said solvent and a non-solvent for said polymer for sufficient time for said synthetic polymer to coagulate, said solvent for said synthetic polymer and said non-solvent of said synthetic polymer being totally or largely miscible one with the other;

(d) washing said woven material onto which said synthetic polymer has been coagulated; and (e) drying said woven material.

4. The process according to claim 3 wherein said synthetic polymer is a polyurethane.

5. The process according to claim 4 wherein said solvent for said synthetic polymer is dimethyl formamide.

6. The process according to claim 3 wherein, after said woven material has been immersed in said solution of synthetic polymer, said support material is passed through rollers which control the thickness of the layer of synthetic polymer applied to said support material.

7. The process according to claim 3 wherein the non-solvent for said synthetic polymer is water.

* * * * *